US005547081A

United States Patent [19]

Mullock et al.

[11] Patent Number: 5,547,081

[45] Date of Patent: Aug. 20, 1996

[54] UNITIZED, STABLE STACKING SYSTEM WITH TIER SHEET STABILIZER, AND METHOD

[75] Inventors: Daniel Mullock, Cincinnati; Paul Baker, Cambridge; John Knight, New Concord, all of Ohio

[73] Assignee: Chiquita Brands, Inc., Cincinnati, Ohio

[21] Appl. No.: 142,587

[22] Filed: Oct. 25, 1993

[51] Int. Cl.[6] ..... B65D 21/032

[52] U.S. Cl. ..... 206/504; 206/821; 206/386; 220/23.6

[58] Field of Search ..... 206/386, 821, 206/504, 503, 515, 518; 220/23.6, 1.5

[56] References Cited

U.S. PATENT DOCUMENTS

| | | | |
|---|---|---|---|
| 1,519,901 | 12/1924 | Boaz et al. | 206/821 |
| 1,826,197 | 10/1931 | Adams . | |
| 2,858,059 | 10/1958 | Kitchell . | |
| 3,282,458 | 11/1966 | Rudd | 206/515 |
| 3,385,429 | 5/1968 | Becker et al. | 206/821 |
| 3,470,851 | 10/1969 | Cannon | 220/23.6 |
| 3,572,577 | 3/1971 | Dorfman . | |
| 3,610,412 | 10/1971 | Morse et al. | 206/821 |
| 3,756,396 | 9/1973 | Kilroy . | |
| 3,863,831 | 2/1975 | Wozniacki et al. . | |
| 4,069,927 | 1/1978 | Taylor | 206/821 |
| 4,175,691 | 11/1979 | Cornell et al. . | |
| 4,474,020 | 10/1984 | Freeman . | |
| 5,116,191 | 5/1992 | Van . | |
| 5,121,877 | 6/1992 | Bodary et al. . | |
| 5,205,410 | 4/1993 | Kuipers et al. | 206/386 |
| 5,287,963 | 2/1994 | Umemoto | 206/821 |

FOREIGN PATENT DOCUMENTS

| | | | |
|---|---|---|---|
| 31869 | 1/1962 | Finland | 206/821 |
| 1130812 | 10/1968 | United Kingdom | 206/504 |
| 2185461 | 7/1987 | United Kingdom | 206/821 |

OTHER PUBLICATIONS

Brochure, Convoy Plastic Pallets, Menasha Corporation, 1991.

Drawing of Prior Art Box Separator.

*Primary Examiner*—Stephen J. Castellano

*Attorney, Agent, or Firm*—Frost & Jacobs

[57] ABSTRACT

A unitized, stable stacking system with a tier sheet stabilizer is provided, along with a method for stacking containers. The tier sheet includes a substantially planar top surface, a bottom surface, peripheral retainers disposed about and extending away from the top and bottom surfaces, respectively, and a plurality of protuberances extending downwardly away form the bottom surface such that said protuberances engage the sidewalls of each container to secure the tier sheet to the containers positioned below the tier sheet. The protuberances are positioned so that the tier sheet can be utilized with several different container layering patterns.

4 Claims, 13 Drawing Sheets

UNITIZED, STABLE STACKING SYSTEM WITH TIER SHEET STABILIZER, AND METHOD

BACKGROUND OF THE INVENTION

This invention relates to an improved system and method for providing a stable, unitized, multi-tiered palletized stack of product containers, and more particularly to a system incorporating a stabilizing tier sheet for placement between layers of stacked containers, such as those used in the shipment of fruit.

Most products that are shipped in bulk are containerized and placed onto standard pallets for ease of handling during shipment. Various types of containers are employed depending upon the products being shipped. Fruit, for example, is most often shipped in rectangular corrugated containers which are stacked in ordered arrangements on wooden pallets. These containers are usually only intended for a single use, and are discarded by the retailer after the product has been sold to consumers. Thus, any reduction in the amount of material used in producing these containers would result in significant cost savings.

Another important factor in the shipment of goods is that the methods employed must insure that the product arrives at its destination undamaged. Often the containers are merely stacked upon a pallet in a convenient arrangement, and shipped in that manner. When the product is in transit, however, the containers may shift and become dislodged from the pallet thereby resulting in damage to the items being shipped. Various means have been employed in the past to correct this problem, including the securing of the containers to one another by means of plastic sheeting wrapped around the perimeter of the palletized of containers.

Another factor which often must be taken into account, especially with fruit, is the necessity for ventilation within the containers. For example, as discussed in more detail in U.S. Pat. No. 5,121,877, which is incorporated herein by reference, bananas are shipped from the production location under refrigeration in an unripened state. During shipment the bananas must be maintained at a temperature of between about 56° and 59° F. in order to insure that the bananas will arrive at the retailer in a marketable condition. Since the bananas will begin to ripen even at this reduced temperature, thereby producing large quantities of heat, it is imperative that adequate ventilation be provided within the stacked containers so that the proper temperature can be maintained. Once the bananas have arrived at the warehouse, the containers are placed in ripening rooms, the pulp temperature is permitted to rise several degrees, and ethylene gas is circulated throughout the stacked containers. Thus, the stacked containers must also permit gas to be circulated amongst the containerized bananas. It will also be apparent to one skilled in the art that numerous products, including other types of fruits and vegetables, require similar ventilation during shipment.

In order to achieve the above-described results, various types of containers and stacking methods have been employed. One such container and stacking method is shown by U.S. Pat. No. 5,121,877, and numerous other designs of varying complexity have also employed by others in an attempt to achieve the desired results.

SUMMARY OF THE INVENTION

It is an object of the present invention to provide a tier sheet for placement between layers of stacked containers.

It is another object of the present invention to provide a stabilizing tier sheet for placement between layers of stacked containers, wherein the containers comprise only a lidless box, thereby significantly reducing the amount of disposable materials employed.

It is yet another object of the present invention to provide a stabilizing tier sheet for placement between layers of stacked containers, wherein proper ventilation and gas circulation can be maintained within the stacked containers.

It is another object of the present invention to provide a method for stacking a plurality of containers in a unitized, stable multi-tiered arrangement, wherein a first tier of containers is arranged in a predetermined pattern, a tier sheet is placed atop the first tier of containers, and a second tier of containers is placed atop the tier sheet, wherein protuberances on the tier sheet engage the containers of the first tier sheet and a peripheral upper retainer retains the second tier of containers on the tier sheet.

It is still another object of the present invention to provide a stabilizing tier sheet for placement between layers of stacked containers wherein the tier sheet is sufficiently rigid so that the stacked containers form an integrated load, thereby stabilizing the unit and reducing the likelihood of damage to the goods within the containers.

The foregoing objects can be accomplished by providing a tier sheet comprising: (a) a top surface comprising an outer perimeter and a substantially planar area for supporting a plurality of said containers; (b) a bottom surface comprising an outer perimeter; (c) a peripheral upper retainer disposed about and extending upwardly away from at least a portion of the perimeter of said top surface; and (d) a peripheral lower retainer disposed about and extending downwardly away from at least a portion of the perimeter of said bottom surface. The tier sheet may further comprise a plurality of protuberances depending downwardly away from said bottom surface, said protuberances located so as to snugly engage the containers aligned therebelow, thereby stabilizing said containers against substantial movement relative to one another. The upper and lower retainers are each defined by a plurality of spaced tabs, preferably wherein said spaced tabs of said upper retainer are offset from said spaced tabs of said lower retainer, so that a first tier sheet may be stacked upon a second tier sheet with the spaced tabs of the lower retainer of the first tier sheet nesting between the spaced tabs of the upper retainer of the second tier sheet.

The protuberances on the tier sheet can be located so as to snugly engage the interior of the open tops of lidless containers aligned therebelow. The protuberances are preferably arranged and spaced so that said containers can be arranged in a plurality of patterns with each of said containers snugly engaged by a plurality of said protuberances, wherein not all of said protuberances engage a container in every pattern arrangement. Each of said protuberances also preferably has at least one contacting edge which is substantially perpendicular to the bottom surface of the tier sheet, and at least a first portion of said protuberances each have a contacting edge positioned parallel and adjacent to the perimeter of said bottom surface. The protuberances are also preferably positioned so that when said tier sheet is placed upon a layer of rectangular, open-topped containers, at least one of said protuberances will snugly engage the interior of each comer of the open top of said containers, thereby securing said tier sheet to said plurality of containers.

Alternatively, the protuberances can be located so as to snugly engage the exterior sidewalls of containers aligned therebelow. In this case, at least a portion of the protuberances are preferably of a substantially elliptical cross-section, wherein said elliptical protuberances comprise a first set aligned parallel to one another and a second set aligned parallel to one another, wherein said first set is aligned perpendicular to said second set.

The tier sheet of the present invention is also preferably nestable with another tier sheet of like construction, and further comprises a plurality of longitudinal stiffening ribs. The tier sheet also preferably has a plurality of ventilation apertures.

The foregoing objects can also be accomplished by providing in combination, a plurality of containers stacked in at least two layers comprising an upper layer and a lower layer, and a tier sheet positioned between said upper and lower layers, said tier sheet comprising: (a) a top surface comprising an outer perimeter and a substantially planar area for supporting said upper layer; (b) a bottom surface comprising an outer perimeter; (c) a peripheral upper retainer disposed about and extending upwardly away from at least a portion of the perimeter of said top surface; and (d) a plurality of protuberances depending downwardly away from said bottom surface; such that said upper retainer retains said upper layer on said top surface, and wherein said protuberances are located so as to snugly engage the sidewalls of at least a portion of the containers of said lower layer, thereby stabilizing said lower layer of containers in a predetermined arrangement. The tier sheet may further comprise a peripheral lower retainer disposed about and extending downwardly away from at least a portion of the perimeter of said bottom surface, such that said lower retainer further stabilizes said lower layer by restricting the movement of the containers of said lower layer relative to one another. The containers may be of an open-topped, lidless variety, and at least a portion of said protuberances will snugly engage the interior sidewalls of the lower layer of containers. The protuberances are also preferably arranged so that said first layer can be arranged in a plurality of patterns. Alternatively, the protuberances can be arranged to snugly engage the exterior sidewalls of the lower layer of containers. At least one of the layers may also have at least one void space, thereby providing ventilation to the interior of said load. Each of the containers of the first layer may have a central ventilation opening in its base, and the tier sheet may have a plurality of ventilation apertures, at least a portion of said apertures positioned directly beneath said ventilation opening and directly above the open top of a container of said lower layer.

The objects of the present invention may also be accomplished by providing a method of stacking a plurality of open-topped containers in a unitized, stable multi-tiered arrangement, comprising the steps of: (a) providing a plurality of open-topped containers; (b) arranging a first tier of said containers in a predetermined pattern; (c) providing a tier sheet having a top surface, a bottom surface, a peripheral upper retainer disposed about and extending upwardly away from at least a portion of the perimeter of said top surface, and a plurality of protuberances depending downwardly away from said bottom surface; (d) placing said tier sheet atop said first tier of containers so that said protuberances snugly engage the sidewalls of at least a portion of the containers of said first tier to thereby maintain said first tier in a stable position; and (e) arranging a second tier of containers in a predetermined pattern on the top surface of said tier sheet, said containers being received within said peripheral upper retainer; whereby a unitized, stable stack of containers is formed. This method may further comprise the steps of repeating steps (d) and (e) in order to provide additional tiers of containers as desired. The containers used in this method may be of the open-topped variety, and the protuberances preferably engage the interior sidewalls of the open tops of at least a portion of said containers.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION OF THE INVENTION

Figure 1:
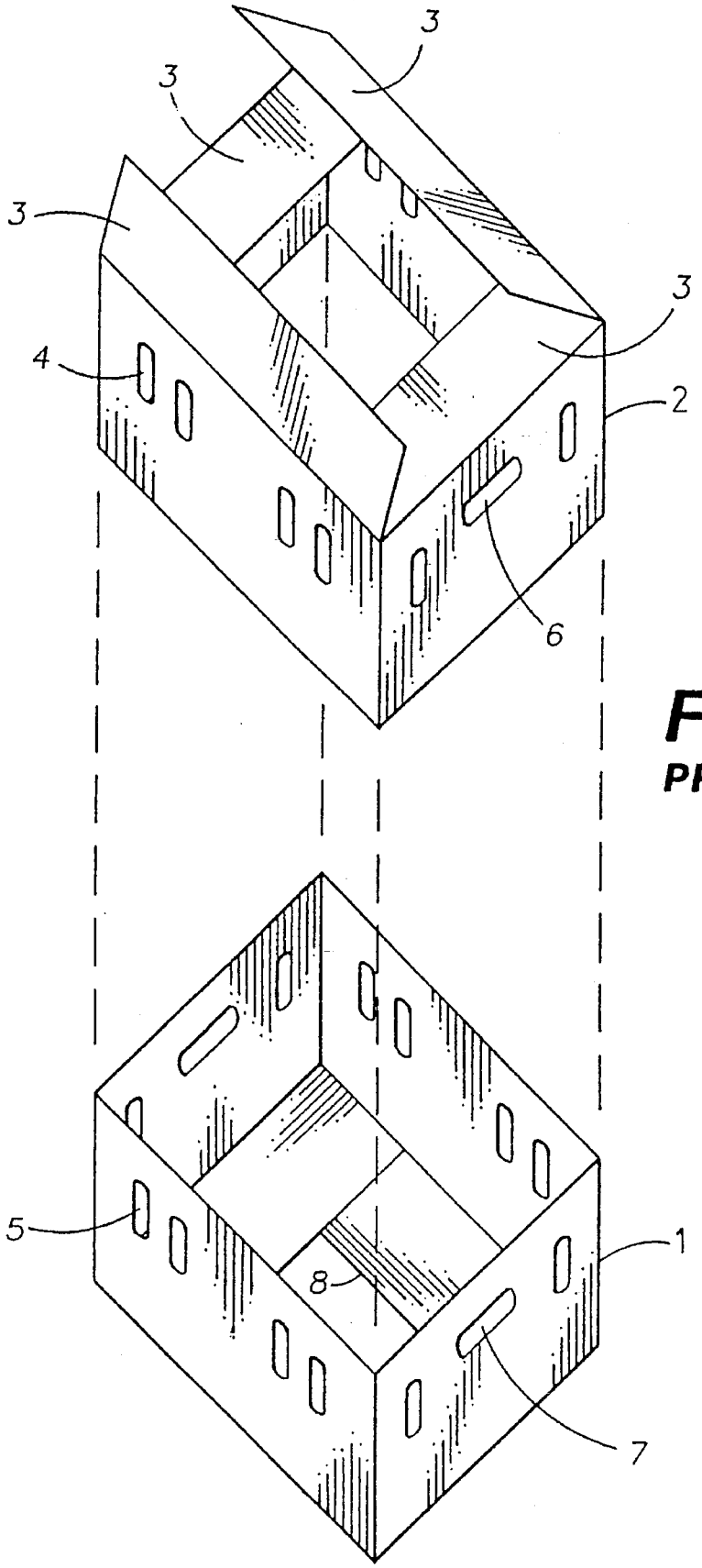
FIG. 1 PRIOR ART
FIG. 1 is a perspective view of a prior art container of the type typically used for shipping fruit such as bananas.

Referring now to the drawings in detail, wherein like numerals indicate the same elements throughout the views, FIG. 1 is a perspective view of a prior art container of the type typically used for shipping fruit such as bananas. Similar containers are used for various products, and many other container configurations are also possible (for example, that shown by U.S. Pat. No. 5,121,877). The container shown in FIG. 1 is often referred to as a full-telescoping, half-slotted container (HSC), and includes a base portion 1 and a lid portion 2. After the items to be shipped are loaded into base portion 1, lid portion 2 is slid onto base portion 1. As shown in FIG. 1, lid portion 2 also comprises top flaps 3 which are folded onto one another and sealed by means of glue or the like. When fruit such as bananas are being shipped, top flaps 3 will typically not completely cover the top of the container, thereby allowing ventilation to the product through a central opening. As also shown by FIG. 1, the bottom of base portion 1 is formed in a similar fashion, thereby providing central ventilation opening 8. In addition, ventilation openings 4 are provided about the sidewalls of lid portion 2, and align with similar ventilation openings provided in base portion 1. Finally, both lid portion 2 and base portion 1 have aligning hand slots, 6 and 7 respectively, which not only provide means by which the container may be lifted, but also additional ventilation openings.

Containers such as that shown in FIG. 1 are typically stacked in layers onto pallets in various patterns for shipment. If ventilation of the product is not a great concern, the containers of FIG. 1 may be stacked side-by-side and end-to-end on the pallet in a tight configuration, such as shown by U.S. Pat. No. 5,121,877. When these containers are used for fruit or other products which require ventilation, however, such a configuration may not always be useable. In these instances, one or more container layers may preferably be stacked in a fashion which increases the space between containers. Obviously layers stacked in this fashion will necessarily comprise a fewer number of containers, and the interposed spaces tend to reduce the stability of the entire load. Such instability during shipment of the product can lead to dislodgement of containers from the pallet, thereby resulting in damage to the product within the dislodged containers.

Figure 2:
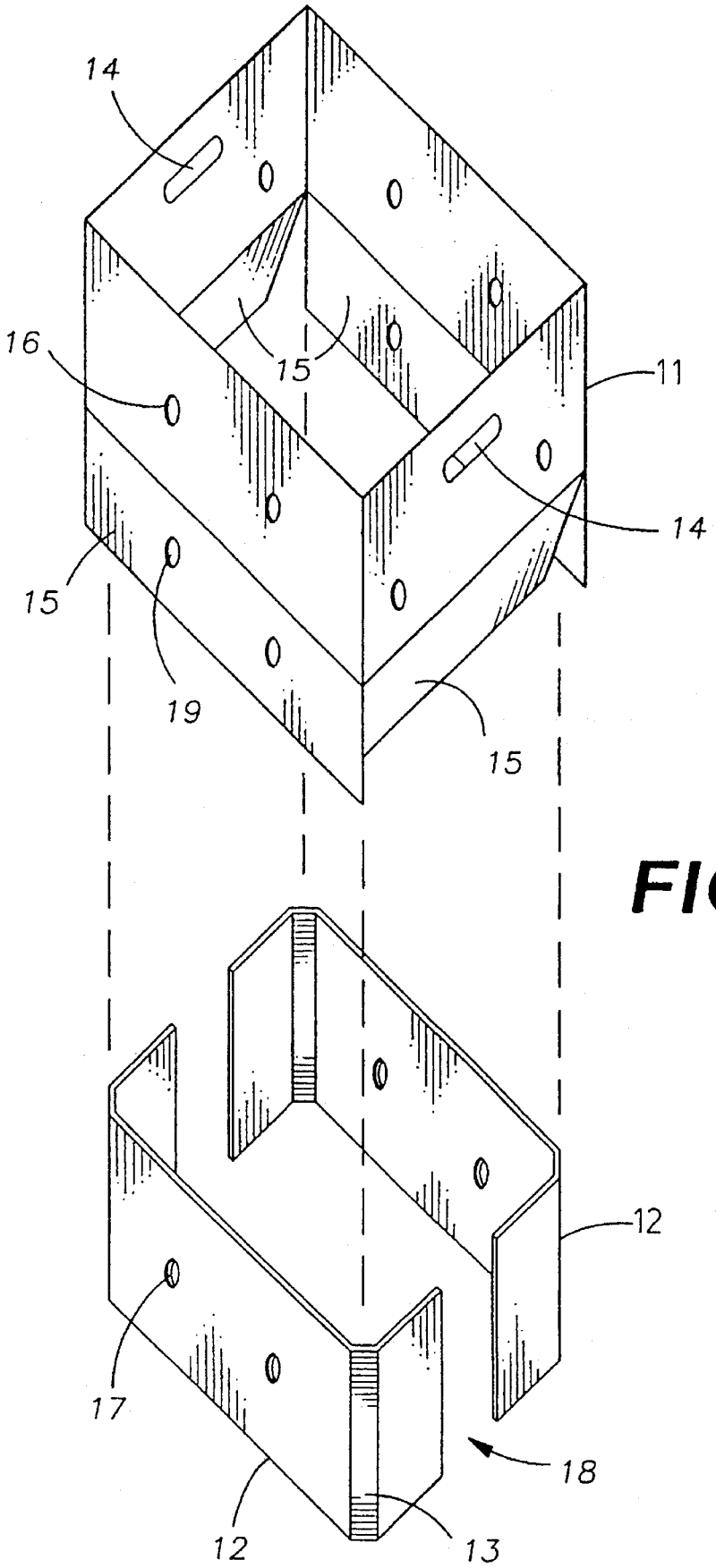
FIG. 2 is a perspective view of an open-topped, or lidless container which can be utilized with the tier sheet of the present invention.

FIG. 2 depicts a container which can be utilized in conjunction with the present invention. Container 11 of FIG. 2 is similar in construction to base portion 1 of the prior art design shown in FIG. 1. Like any common rectangular container (i.e., a box), rectangular container 11 comprises four vertical sidewalls, and attached bottom flaps 15. Bottom flaps 15 are folded over in the conventional manner to thereby form the container. The width of bottom flaps 15 are such that the bottom of container 11 formed by flaps 15 will not be a continuous surface. In other words, as is the usual case with containers wherein ventilation may be important, a central opening will be provided in the bottom of container 11 when flaps 15 are folded over and sealed to one another in a conventional fashion (such as by glue). Container 11 also has ventilation openings 16 provided in its sidewalls, as well as ventilation openings 19 provided in bottom flaps 15. Any number of ventilation openings may be provided depending upon the product being shipped as well as considerations of container strength. As was the case in the container of FIG. 1, hand slots 14 are provided in the side walls of container 11, and these slots serve the same dual purpose (ventilation and grasping means) as previously described.

It will be readily apparent that container 11 of FIG. 2 lacks a lid portion or any other means for covering the top of the container (i.e., is "open-topped"). As will be more fully understood when the tier sheet of the present invention is described, the ability to use an open-topped container such as that shown by FIG. 2 is one important advantage of one embodiment of the present invention. Typical containers previously employed for shipment of product on pallets have invariably had some form of lid or top portion. This top portion would comprise that shown in FIG. 1, or alternatively, top flaps similar to bottom flaps 15 of container 11 were provided. When one embodiment of the tier sheet of the present invention is employed, however, a completely open-topped container can be used. This results in significant cost savings, since less material will be employed for the construction of the containers. As mentioned previously, shipping containers, which are often made of corrugated board, are generally disposed of after a single use. Thus, employing the container design of FIG. 2, as opposed to that of FIG. 1, results in a significant reduction in the amount of disposed material.

In many instances, it may be necessary to reinforce container 11, particularly when no lid is present. Thus, as shown in FIG. 2, support inserts 12 are preferably utilized. Inserts 12 fit within container 11 against the side walls of the container. Obliquely angled corner portions 13 on support inserts 12 provide added support, as a stronger triangular structure will be situated in each corner of container 11 employing inserts 12. When ventilation openings 16 are provided in the sidewalls of container 11, corresponding alignable ventilation openings 17 can be provided in inserts 12 so that unimpeded fluid communication to the interior of the container will be maintained. In addition, when inserts 12 are placed in container 11, open space 18 will exist between the two inserts. Space 18 will preferably be aligned with hand slots 14, thereby preserving the ability of container 11 to be grasped and ventilated via hand slots 14.

While container 11 of FIG. 2 has been described in detail, as will be more fully understood through discussion of the tier sheet of the present invention described below, any open-topped container may be employed with one embodiment of the tier sheet of the present invention. The container design shown in FIG. 2 is, however, may be particularly preferred when fruit such as bananas are being shipped. The use of container 11 of FIG. 2, even with inserts 12 in place, results in a significant reduction in overall container weight, as compared to the container shown in FIG. 1. This in turn results in a weight reduction of approximately 63 lbs for a pallet load of 48 boxes. Obviously this results in significant cost savings to the producer or shipper, as well as a reduction in the amount of shipping materials, which must be recycled or otherwise disposed of.

Figure 3:
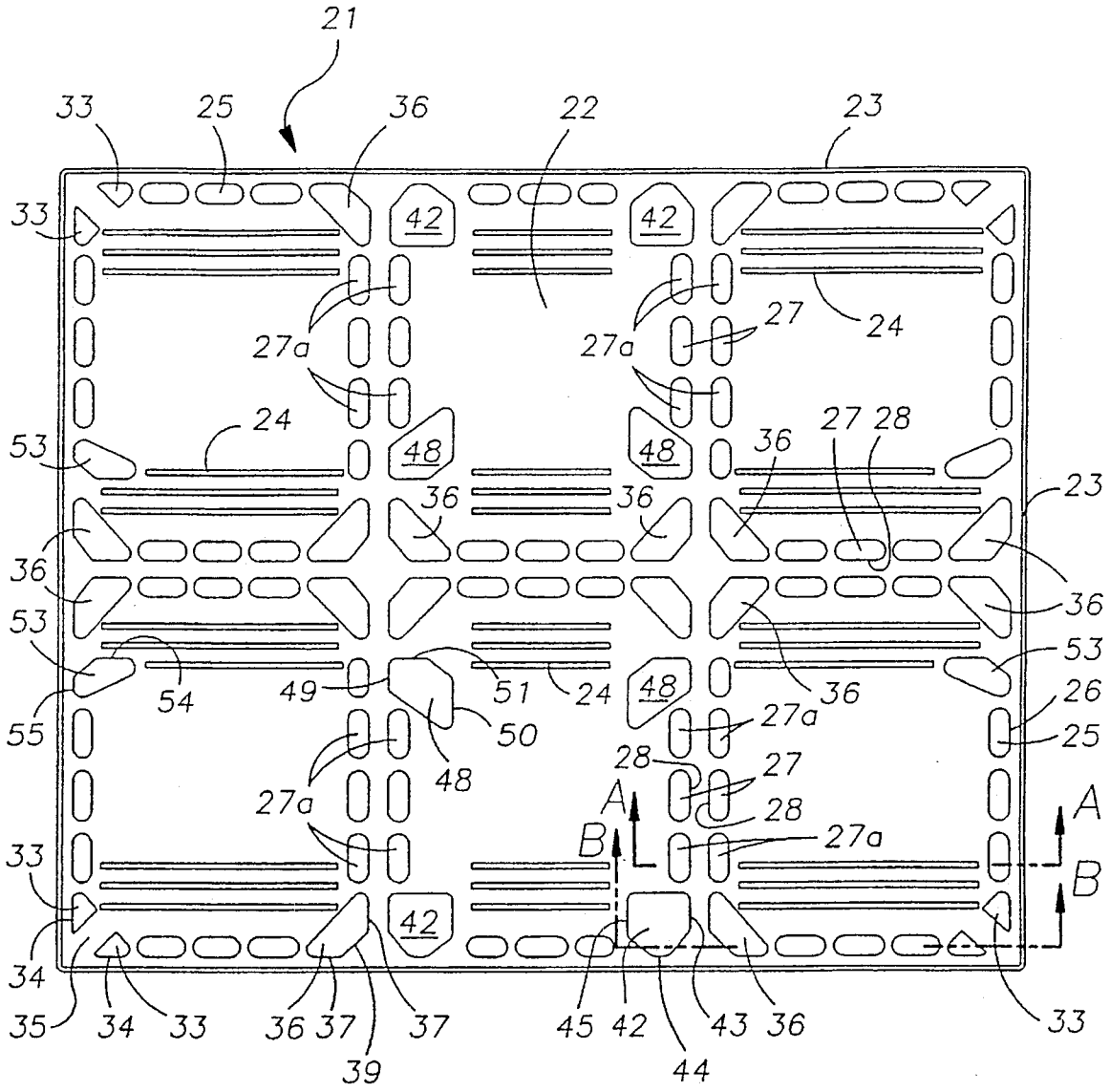
FIG. 3 is a top plan view of an embodiment of the tier sheet according to the present invention.

Turning now to the tier sheet itself of the present invention, FIG. 3 is a top plan view of a preferred embodiment of tier sheet 21. Tier sheet 21 is generally rectangular in shape, since the vast majority of shipping containers, and the resulting pallet loads of stacked containers, are of a similar shape. Obviously, other shapes could be employed for tier sheet 21 depending upon the shape of the containers being used.

Tier sheet 21 comprises a top surface 22 having a substantially planar area upon which above-stacked shipping containers may rest. A peripheral upper retainer 23 is disposed about at least a portion of the perimeter of top surface 22, and preferably extends around the entire perimeter substantially perpendicular to top surface 22. As more clearly shown by FIGS. 8 and 11, the peripheral upper retainer is preferably defined by a plurality of spaced, upwardly extending tabs 58. The spacing between tabs 58 can vary. depending upon the dimensions of the containers being stacked. Of course the distance between any two upwardly extending tabs 58 should not be greater than the shortest sidewall of a container being shipped, else tabs 58 may not adequately retain the container on tier sheet 21. While peripheral upper retainer 23 may comprise a continuous surface extending perpendicularly away from top surface 22, it is preferred that alternating tabs 58 be employed.

Figure 8:
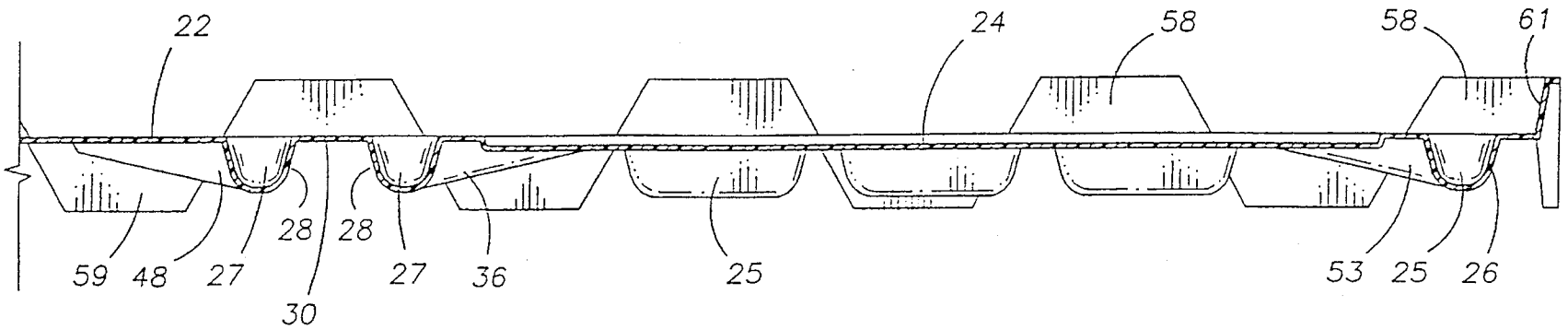
FIG. 8 is a cross-sectional view of a tier sheet according to the present invention taken along line A—A of FIG. 3.
Figure 10:
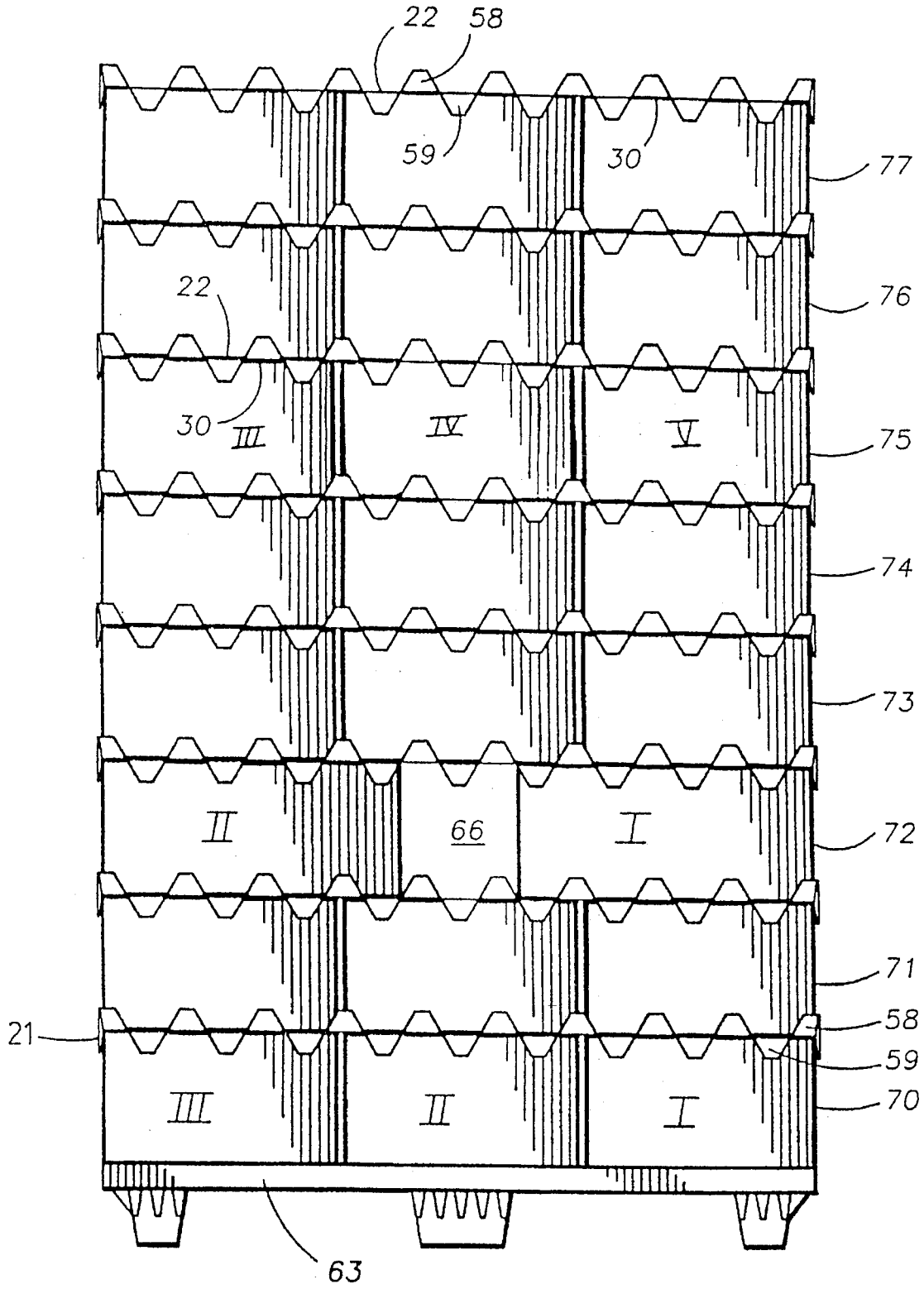
FIG. 10 is a side view of a pallet loaded with containers having a tier sheet of the present invention placed between each layer of containers.

As also shown in FIGS. 8 and 10, downwardly extending tabs 59 preferably extend substantially perpendicularly downward from bottom surface 30 of tier sheet 21, thus providing a peripheral lower retainer about the perimeter of the bottom surface 30. Downwardly extending tabs 59 are also preferably offset from upwardly extending tabs 58. This alternating pattern permits a first tier sheet to be stacked upon a second tier sheet with upwardly extending tabs 58 of the second tier sheet nesting between the downwardly extending tabs 59 of the first tier sheet. This nesting of like tier sheets when stacked upon one another is significant since it permits tier sheets of the present invention to be compactly transferred from one location to another, or compactly stored, when they are not being used. Of course should the nesting of the tier sheets with one another not be important, upper peripheral retainer 23 may be a continuous surface, and downwardly extending tabs 59 may likewise be replaced by a continuous surface substantially perpendicular to bottom surface 30 of tier sheet 21.

Figure 11:
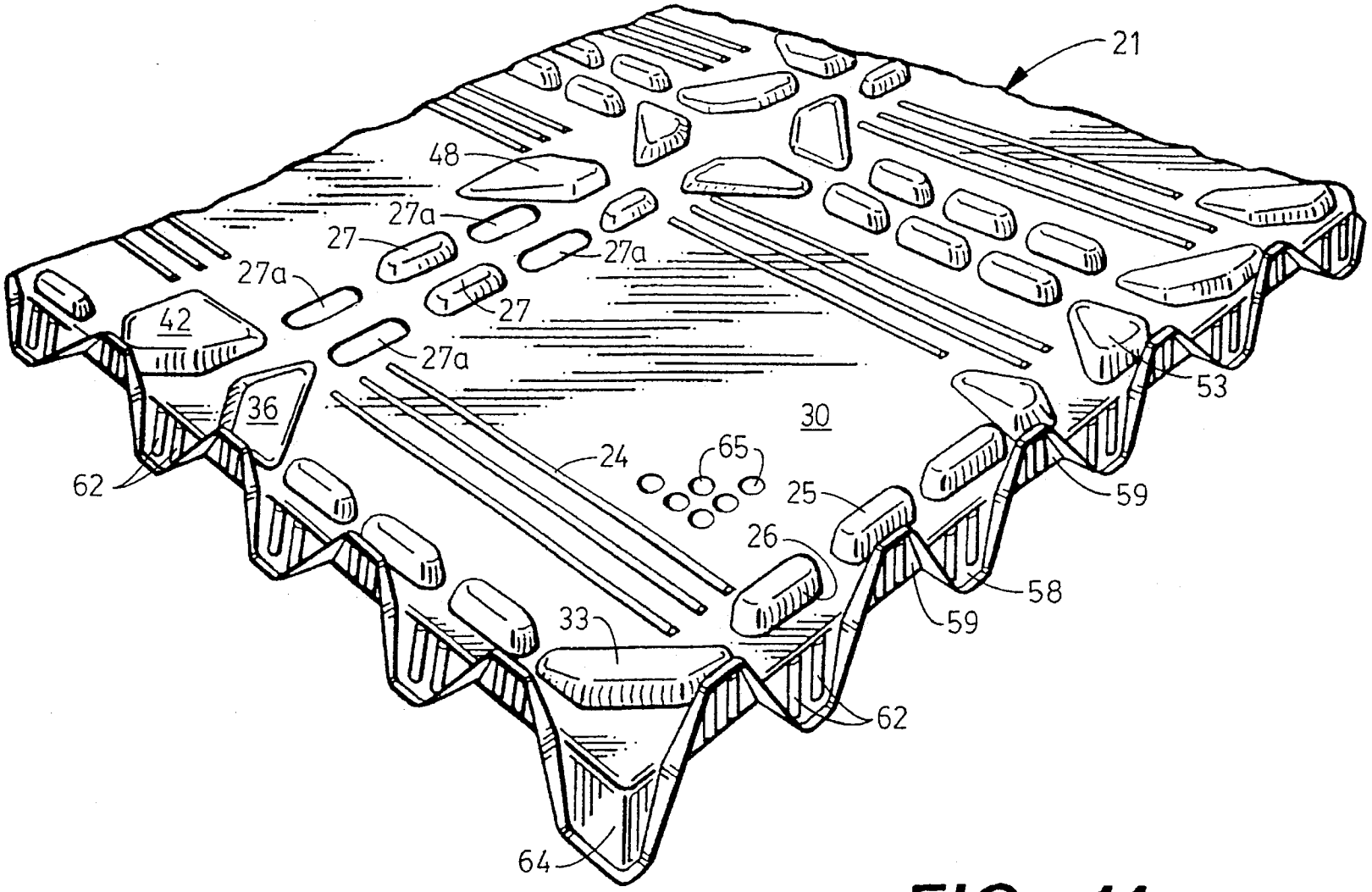
FIG. 11 is a partial perspective view of the bottom portion of one embodiment of the tier sheet of the present invention.

As also shown in FIG. 11, upwardly extending tabs 58 and downwardly extending tabs 59 each have one or more stiffening ribs 62 extending perpendicular away from the top and/or bottom surfaces of the tier sheet. Stiffening ribs 62 are preferably molded into tabs 58 and 59, and decrease the flexibility of the tabs. This helps to ensure that the tabs will not flex outwardly, thereby possibly permitting the stacked containers to become dislodged.

Figure 5:
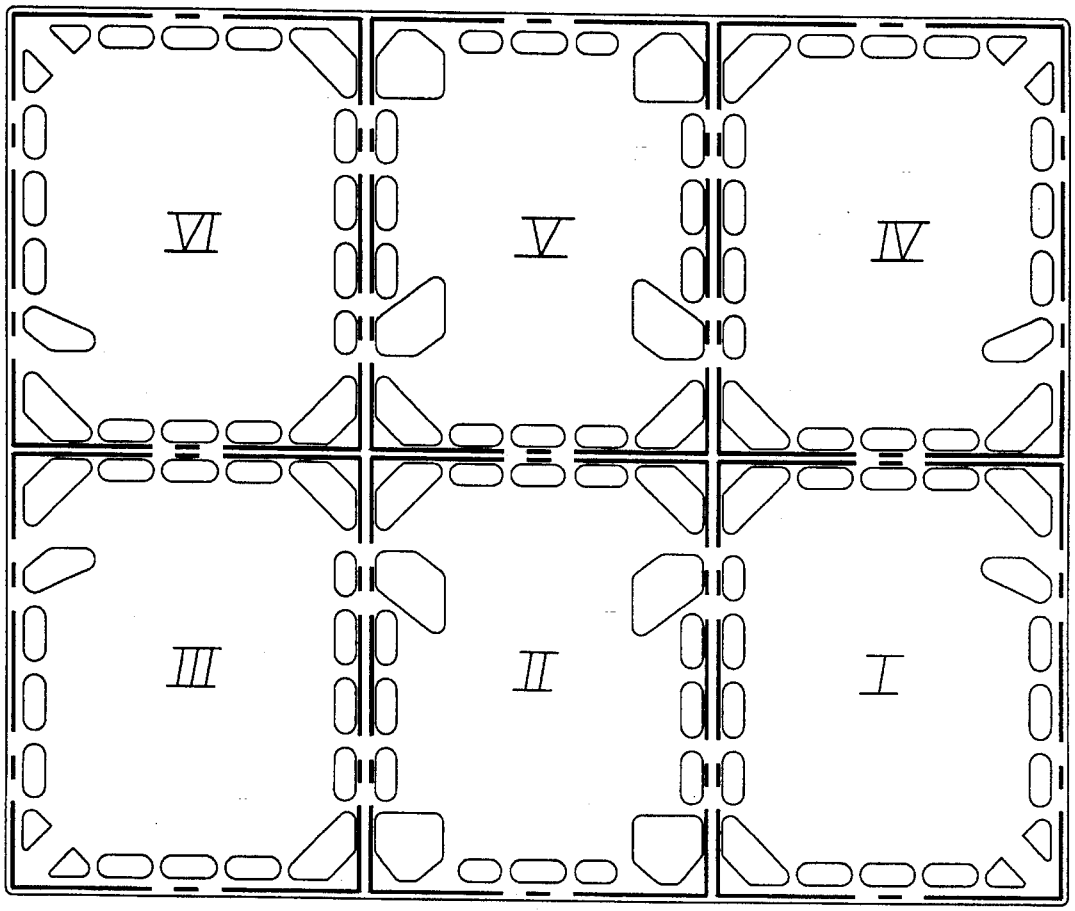
FIG. 5 is a bottom plan view of the tier sheet of FIG. 3, and also depicts the outline of a six-container layer into which the protuberances of the tier sheet are inserted.

FIG. 10 depicts a multi-layer load of containers utilizing tier sheet 21 of the present invention. A first tier (or layer) 70 of open-topped containers is placed upon pallet 63 in the usual fashion. While pallet 63 may be of any design and of any of a variety of materials, it is preferred that pallet 63 be of a plastic construction such as the type now often employed for shipping purposes. Once the first tier of open-topped containers has been placed upon pallet 63, a tier sheet 21 is then placed upon first layer 70. The dimensions of tier sheet 21 are such that downwardly extending tabs 59 will extend about, and on the outside of, the entire first layer of containers. Tabs 59 thereby help to ensure that the containers will not move substantially relative to one another, nor become dislodged from pallet 63, particularly when multiple layers of containers are stacked upon the pallet. Of course this retaining feature of downwardly extending tabs 59 is more effective when greater weight is placed upon tier sheet 21, and, more importantly, when the first layer of containers is arranged in a tight pattern (with little or no space between adjacent containers). Such a tight configuration for the first layer is shown in FIG. 5, and this pattern will be discussed in more detail later. Additionally, as shown by FIG. 11, upwardly extending tabs 58 are preferably disposed around the entire comer of tier sheet 21, thereby providing upwardly extending comer support 64. Comer support 64 acts to further limit the movement of a layer containers placed upon tier sheet 21, and particularly prevents rotational movement of the containers. Alternatively, the comer support could be reversed so as to downwardly extend.

As further shown in FIG. 10, a second tier 71 of open-topped containers is placed upon tier sheet 21 within the confines of upwardly extending tabs 58. In this fashion, peripheral upper retainer, defined by the upwardly extending spaced tabs 58, will act to retain, and limit the movement of the second layer of containers. Once again if the second layer is also arranged in a tight configuration, upwardly extending tabs 58 will be most effective. Successive layers of open-topped containers can then be stacked upon the first two in a similar fashion, with each tier sheet placed between layers in order to stabilize the entire load of containers.

It should be noted that in FIG. 10 two of the layers are not in the tight configuration mentioned previously. For example third layer 72 has a void 66 present. Void 66 may be needed when additional ventilation within a multi-layer load of containers is needed, and this may be achieved by placing one or more layers in a more open (i.e., non-tight) configuration. This will, however, be described more completely when the additional preferred features of tier sheet 21 are described.

In many instances it may be desirable to provide additional features on tier sheet 21. Particularly, when significant void spaces are provided in layers of containers on a pallet, it may be necessary to provide further means for limiting the movement of the containers within the load in addition to the upper and lower peripheral retainers. While the upper and lower peripheral retainers will indeed act to minimize movement of containers within the confines of tier sheet 21, at times, additional movement restrictors may be needed. Thus, as shown in FIG. 3, and more clearly by the enlarged view of FIG. 4 and the perspective view of FIG. 11, a plurality of bulbous protuberances (e.g., protuberance 25) may be provided on the underside of tier sheet 21. For example, a plurality of half-ovoidal protuberances 25 may be provided on the underside, or bottom surface 30, of tier sheet 21. These protuberances preferably extend away from bottom surface 30 of tier sheet 21, thereby maintaining the substantially planar structure of top surface 22. Although the preferred manufacturing methods for tier sheet 21 will create depressions in top surface 22 corresponding to the protuberances extending away from bottom surface 30, there is still an effectively planar area for supporting the substantially flat bottomed containers. The depressions in top surface 22 corresponding to the protuberances are also significant in that they enable tier sheet 21 to be placed atop a second like tier sheet with the protuberances of the tier sheet nesting within the corresponding depressions of the second tier sheet. As mentioned previously, the nestability of the tier sheet is significant when the tier sheet is being stored or shipped, as it reduces the amount of space required.

The purpose of the plurality of protuberances extending away from bottom surface 30 of tier sheet 21 is to further secure tier sheet 21 to each layer of containers, thereby increasing the integration of the multi-layer load of containers. The protuberances will snugly engage the interior sidewalls at the open tops of a layer of containers placed beneath the tier sheet, thereby securing the tier sheet to the layer. This integration, or unitization, forms a stabilized multi-layer load of containers which tends to act as a single unit, thereby ensuring that no individual containers will become dislodged and lessening the impact of any vibratory or other external forces acting upon the containers. Testing has shown that when the preferred embodiment for tier sheet 21 is used in conjunction with a multi-layered load of containers, the entire load moves in unison as the forces typically encountered during shipment are applied to the load. In fact, when a portion of a comer of container I of layer 72 in FIG. 10 was cut away, the entire load nevertheless maintained its integrity without any adverse effects even when large vibratory movements were applied to the pallet load.

The plurality of bulbous protuberances extending away from bottom surface 30 of tier sheet 21 are arranged in a pre-selected fashion so that the protuberances are able to snugly engage the interior sidewalls of the containers through the open tops of the containers. Each protuberance has at least one contacting edge which will generally rest against or engage the inner sidewall of a container adjacent to the open top of the container. As will be more fully understood later, since tier sheet 21 is designed to be utilized with a number of different container layering patterns, at times one or more of the protuberances will not extend within the sidewalls of a container, but rather will lie within one of the void spaces mentioned previously. Nevertheless, those that do extend within the sidewalls of a container will usually have at least one contacting edge snugly engaging the inside surface of a vertical sidewall of the containers. In this fashion, the bulbous protuberances, through their contacting edges, apply a outward force to the container sidewalls thereby maintaining and supporting the rectangular shape of the containers. Thus, the protuberances nest within and engage the open top of the containers against the interior of the sidewalls, thereby securing tier sheet 21 to the containers.

As mentioned previously, it is desirable that one be able to use tier sheet 21 with a variety of container layering patterns. FIG. 5 depicts the tight container layering pattern described previously. It should be noted that FIGS. 5, 6 and 7 only depict the outline of the tier sheet and the placement of the various protuberances. The roman numerals in FIG. 5 designate each of the six containers present, which are in turn represented by the dashed lines. As will be apparent, the tight configuration results in the containers being placed side-by-side and end-to-end. This results in little or no space between each container. As FIG. 5 depicts, each protuberance of tier sheet 21 is positioned within the sidewalls of one of the containers, and each has at least one contacting edge resting against, and snugly engaging the inner surface of a vertical sidewall of a container. Thus, all of the protuberances nest within a container when the tight layering pattern of FIG. 5 is employed. Outer half-ovoidal protuberances 25, for example, lie adjacent the periphery of tier sheet 21, and outer edge 26 of half-ovoidal protuberances 25 are immediately adjacent and parallel to downwardly extending tabs 59. Thus, when tier sheet 21 is placed upon a layer of containers configured in the tight pattern of FIG. 5, at least one vertical sidewall on each container will be wedged between several outer contacting edges 26 and downwardly extending tabs 59. In this fashion tier sheet 21 is secured to each container in the layer, and each container is thereby secured as a unitary layer by means of tier sheet 21. Since the protuberances snugly engage the sidewalls of the containers, it is possible to eliminate the lower retainer defined by tabs 59 yet still secure the tier sheet to a layer of containers positioned beneath.

The number and placement of the protuberances extending from bottom surface 30 of tier sheet 21 can be varied depending upon the type of service for which tier sheet 21 is being employed. Obviously the more protuberances utilized, the more firmly tier sheet 21 will be secured to each container. Thus, while the preferred embodiment of tier sheet 21 employs a number of such protuberances having varied shapes, it is certainly possible to employ only a small number of these and achieve satisfactory results.

Remaining with the configuration shown by FIG. 5, and examining the tier sheet shown by FIG. 3, outermost corner protuberances 33 are provided adjacent to the four corners of the perimeter of tier sheet 21 (two protuberances 33 per corner). Each of outermost corner protuberances 33 also has an outer contacting edge 34. Each outer contacting edge 34 lies immediately adjacent and parallel to the outer periphery of tier sheet 21, and therefore is also adjacent and parallel to downwardly extending tabs 59. This allows outermost corner protuberances 33 to snugly nest within the four outermost corners of the container layer of FIG. 5. The container sidewalls nearest to the outermost corners of the layer will be wedged, and thereby held, between contacting edges 34 and tabs 59. In the configuration of FIG. 5, these four outermost corners are the most vulnerable since the container sidewalls which form each of these corners do not lie adjacent to the sidewalls of another container. Thus, outermost corner protuberances 33 act to maintain the integrity of the outermost corners of the container layer as well as to secure the tier sheet to the container layer.

Figure 4:
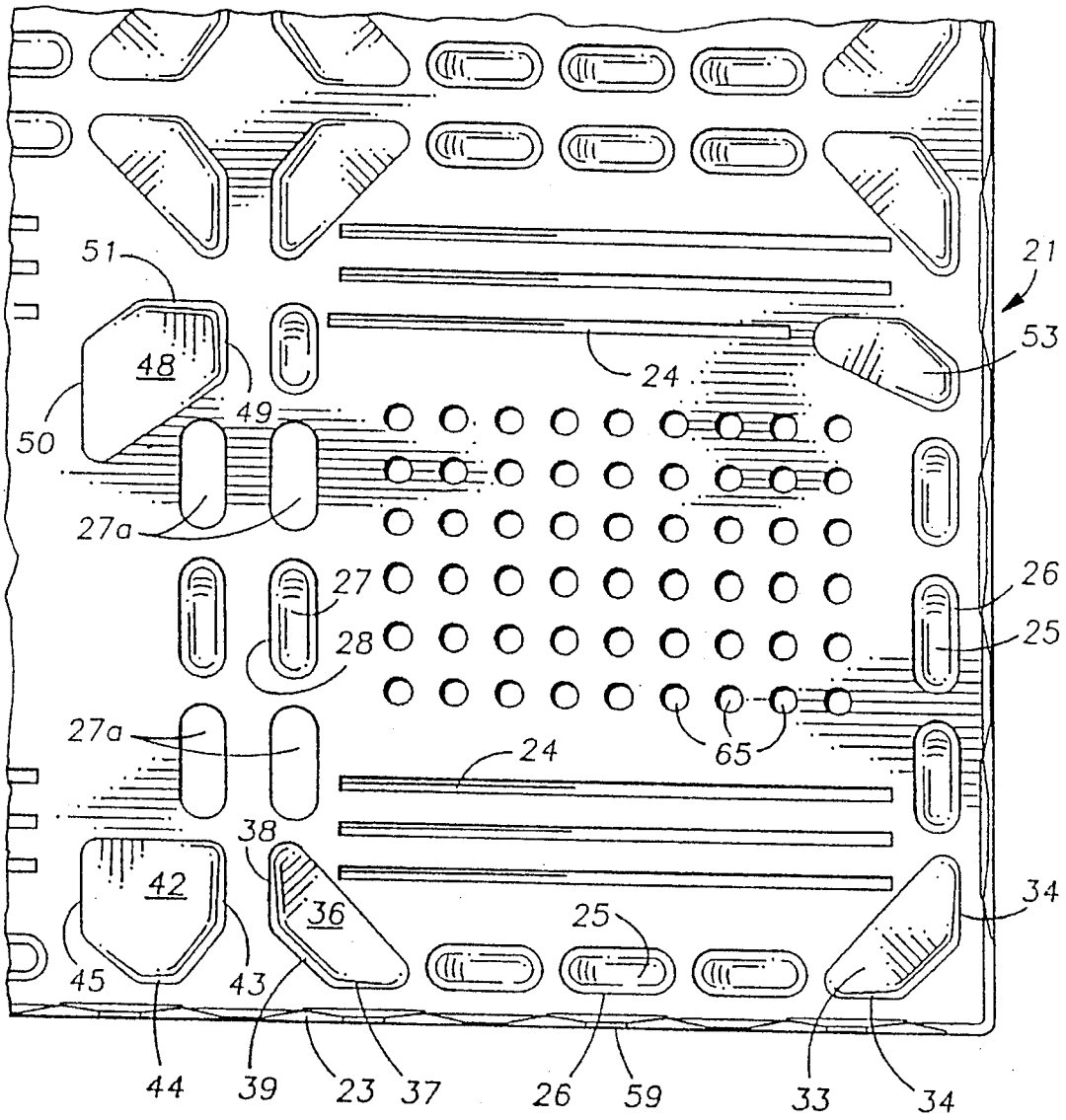
FIG. 4 is an enlarged bottom view of the lower left hand comer of the tier sheet of FIG. 3.

The enlarged view of FIG. 4 depicts an alternative embodiment for outermost corner protuberances 33. In this embodiment, the central support surface 35 which lies between adjacent outermost corner protuberances 33 (as shown in FIG. 3) has been eliminated. In its place, a single outermost corner protuberance 33 will exist for each of the four corners of the tier sheet. The configuration for outermost corner protuberances 33 shown in FIG. 3 is preferred, however. The reason for this preference is that, as described previously, tier sheet 21 is preferably manufactured by means of a molding process, and therefore depressions will exist in top surface 22 corresponding with protuberances on bottom surface 30, such as outermost corner protuberances 33. Testing has shown that when the configuration of FIG. 4 for protuberances 33 is employed and a second layer of containers is placed on top surface 22, the bottom outermost corners of the second layer of containers will tend to slide into the depression on top surface 22 corresponding to outermost corner protuberances 33. This results in a shifting of the containers which could be detrimental to stability. By providing support surface 35 between dual outermost corner protuberances 33 (as shown by FIG. 3), this potential problem can be avoided.

In order to not only firmly secure tier sheet 21 to each container in a layer, but also to further support every sidewall of each container, it is preferable that additional protuberances be provided on bottom surface 30 of tier sheet 21. Thus, interior half-ovoidal protuberances 27, each having a contacting edge 28, are also provided on tier sheet 21. As shown by FIGS. 3 and 5, contacting edges 28 of interior half-ovoidal protuberances 27 will rest against and snugly engage the interior surface of a vertical sidewall of the containers. In fact, when the tight layering configuration of FIG. 5 is employed, adjacent sidewalls of containers, such as containers I and II, will be wedged between adjacent contacting edges 28 of interior half-ovoidal protuberances 27. This acts to further secure tier sheet 21 to the layer of containers, and also acts to support the vertical structure of the sidewalls of each container.

Since the corner portions of each container which are not supported by protuberances 33 are also important in maintaining the container structure, additional corner protuberances for the layering pattern of FIG. 5 are also preferably provided. Thus, corner protuberances 36 each having two contacting edges 37 are also provided. As shown by FIG. 5, when viewed in conjunction with FIG. 3, corner protuberances 36 each nest within a corner of a container when the tight layering configuration of FIG. 5 is employed. Contacting edges 37 will rest against the interior sidewalls of a container adjacent to a corner of the container. The sidewall adjacent contacting edges 37 will thus be secured either between contacting edge 37 and downward tabs 59 around the perimeter of tier sheet 21, or between contacting edge 37 and the sidewall of an adjacent container.

As will be apparent from a review of FIG. 5, in conjunction with FIGS. 3 and 4, additional protuberances not only further secure tier sheet 21 to the layer of containers, but also provide additional support to the sidewalls of each container. Thus, protuberances 42, 48 and 53 are preferably also provided. Protuberance 42 has three contacting edges, namely edges 43, 44 and 45. When the tight layering pattern of FIG. 5 is employed, however, only contacting edges 43 and 44, as shown in FIG. 5, will snugly engage an interior sidewall of a container. A container sidewall will be wedged between contacting edge 44 and downward tabs 59, and a container sidewall will also be wedged between contacting edge 43 and an adjacent container sidewall.

Protuberances 48 are also provided, and these also have three contacting edges, namely edges 49, 50 and 51. In this case, however, when the tight layering pattern of FIG. 5 is employed, only contacting edge 49 will engage the inner surface of a sidewall of a container. A portion of the sidewall of a container will be wedged between edge 49 and an adjacent container sidewall. Finally, protuberances 53 having contacting edges 54 and 55 are provided. Only contacting edge 55, however, will engage the interior sidewall of a container when the tight layering pattern of FIG. 5 is employed. A portion of the sidewall of a container will be wedged between contacting edge 55 and downwardly extending tabs 59. Thus, as shown by FIG. 5, the protuberances of tier sheet 21 will all nest within a container, thereby not only securing tier sheet 21 to the layer of containers but also applying an outward force to the interior sidewalls of each container thereby maintaining the rectangular shape of each container.

Figure 6:
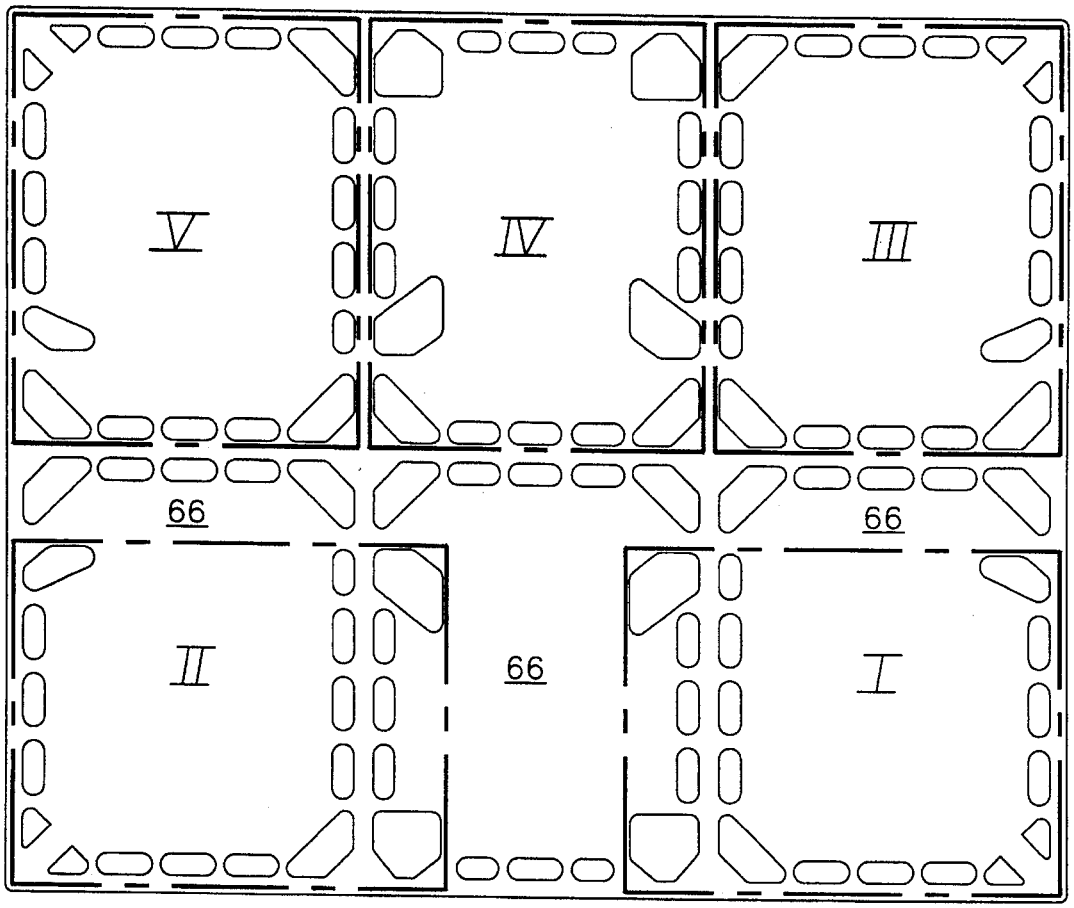
FIG. 6 is a bottom plan view of the tier sheet of FIG. 3, and also depicts the outline of a five-container layer into which the protuberances of the tier sheet are inserted.

As mentioned previously, it is often desirable to arrange the containers in a configuration other than the tight pattern of FIG. 5. This is particularly true when one wishes to provide additional ventilation in a multi-layer load of containers. Thus, an alternative layering pattern is shown in FIG. 6. Containers III, IV and V of FIG. 6 are arranged in a side-by-side fashion similar to that of FIG. 5. Containers I and II, however, have been rotated 90° from that of FIG. 5 and are located adjacent to the periphery of tier sheet 21. Thus, void space 66 will be present in this layer.

Since containers III, IV, and V in the configuration of FIG. 6 are positioned in the same fashion as previously described, the protuberances of tier sheet 21 nest within these containers in the manner described previously. Even though containers I and II have been positioned quite differently from that of FIG. 5, however, a significant number of protuberances extending from bottom surface 30 of tier sheet 21 are nested within these containers with their contacting edges snugly engaging the interior sidewalls of containers I and II. In particular, as shown by FIG. 6 when viewed in conjunction with FIG. 3, contacting edges 54 of two of protuberances 53 will now engage an interior sidewall of containers I and II. Likewise, contacting edges 51 and 50 of protuberances 48, as well as contacting edge 45 of two of protuberances 42 will also engage the interior sidewall of containers I and II. At the same time, outer contacting edges 26 of half-ovoidal protuberances 25 act in the same fashion as previously described, as do outer contacting edges 34 of outermost comer protuberances 33. Therefore, even though containers I and II of FIG. 6 have been repositioned, protuberances extending from bottom surface 30 of tier sheet 21 nest not only within each corner of these containers, but also along the length of two of their sidewalls, namely the two sidewalls adjacent to the perimeter of tier sheet 21.

Figure 7:
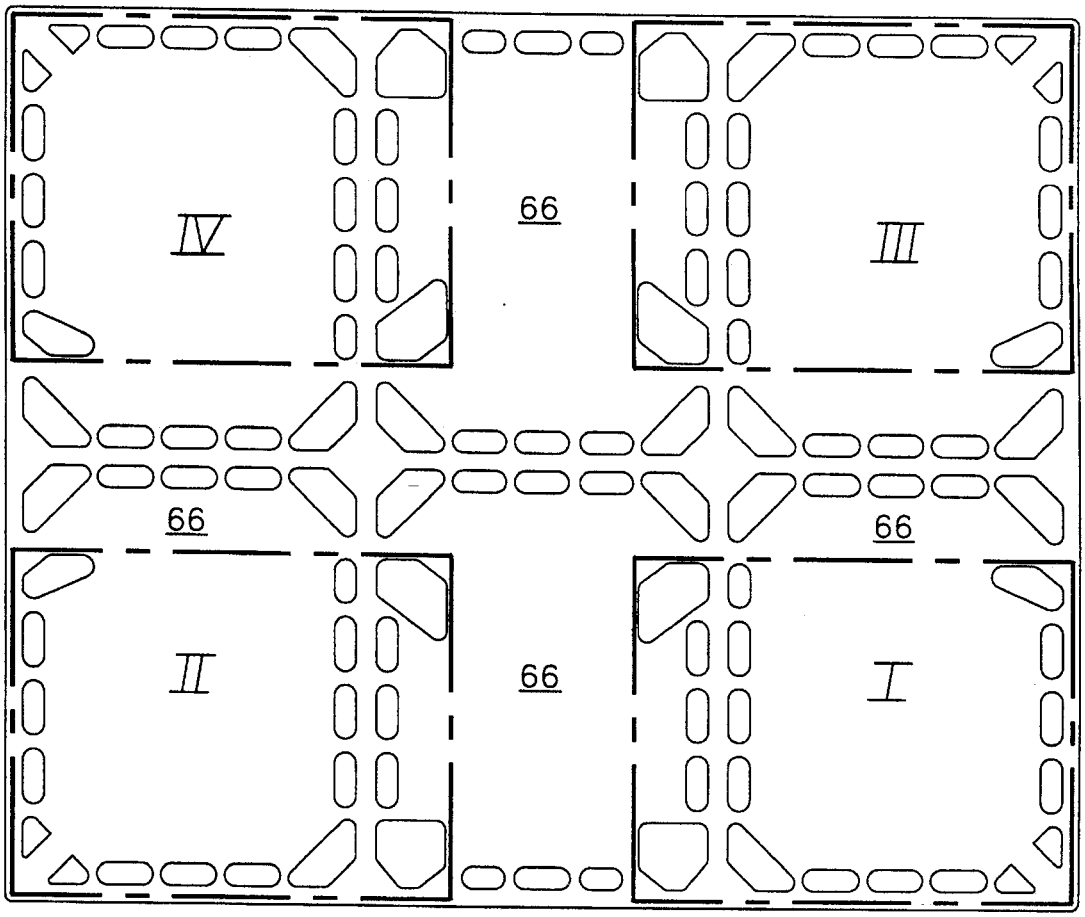
FIG. 7 is a bottom plan view of the tier sheet of FIG. 3, and also depicts the outline of a four-container layer into which the protuberances of the tier sheet are inserted.

FIG. 7 depicts yet another container layering configuration which may be used in conjunction with the tier sheet of the present invention. Containers I and II are positioned identically to that of FIG. 6. Likewise, Containers III and IV are positioned on the opposite side of the layer in identical fashion to that of I and II. Thus, the protuberances of tier sheet 21 will nest within Containers III and IV in the same fashion as that described for Containers I and II in conjunction with the description of the layering pattern of FIG. 6. This provides a plurality of void spaces 66 within the layer of containers, however it does sacrifice container volume since only four containers will be present in this layer.

It should be noted that, as shown in FIGS. 4 and 11, a portion of the interior half-ovoidal protuberances may be omitted or reduced in height. These protuberances are designated as 27*a*, and are preferably reduced in height as compared to protuberances 27. Protuberances 27*a* are preferably employed when bruisable products such as bananas are being shipped in the lidless containers described previously. When the layering patterns of FIGS. 6 or 7 are employed, protuberances 27*a* will extend into the interior of the containers positioned below. It has been found that, due to the manner in which bananas are typically loaded into the containers, protuberances 27*a* must be reduced in height so that they will not contact, and thereby bruise, the bananas. If needed, other protuberances may be similarly reduced in height as necessary.

FIGS. 5, 6 and 7 thus demonstrate that the tier sheet of the present invention can be effectively employed with at least three distinct container layering patterns, namely 6-, 5- and 4-container layering patterns. Depending upon the type of goods being shipped, as well as other factors, more than one of these layering patterns may be employed for a particular pallet load. The load shown by FIG. 10 is a preferred pattern for the shipment of fruits such as bananas since the provision of adequate ventilation in the multi-layer load of containers is important. Thus, first and second container layers 70 and 71, respectively, are of the six-container configuration of FIG. 5 with the containers at positions I, II, and III indicated in FIG. 10. The third and sixth layers of FIG. 10, namely layers 72 and 75 respectively, are preferably of the five-container configuration of FIG. 6. As shown in FIG. 10, however, layer 75 is rotated 180° in relation to layer 72. Thus, in the side view of FIG. 10, containers I and II of the five-container layering pattern are visible in layer 72, while containers III, IV and V of the five-container layering pattern are visible in layer 75 of FIG. 10. Void space 66 is shown in layer 72, however it will be apparent that this void space only extends half the distance across tier sheet 21. Likewise, a corresponding void is also present in layer 75 directly behind container IV shown in FIG. 10. Finally, layers 73, 74, 76 and 77 are once again of the six-container layering pattern (i.e., the tight configuration). It is also possible to provide 5-container patterns for layers 73 and 74 when farther ventilation is needed. While this reduces the number of containers in the load by 2, it may be preferable at times. When this pattern is employed, it is preferred that the containers are positioned so that void space 66 alternates sides of the load in layers 72–75.

While a tier sheet 21 is placed between each layer of containers in FIG. 10, with each successive layer resting upon top surface 22 of the tier sheet, a final tier sheet is also preferably placed atop uppermost layer 77. In this fashion, the contents of the containers of layer 77 will be protected. Of course other coverings may be employed on uppermost layer 77, since further container layers are not stacked above layer 77.

When fruit such as bananas arrive at a warehouse ripening room it is often necessary to provide even further ventilation than that which was provided during transit. Thus, when the tier sheet of the present invention is used in conjunction with the layering pattern of FIG. 10 for shipping purposes, the containers may be removed from their boxes and arranged in the four-container pattern of FIG. 7 in the ripening room. Since stacked containers in a ripening room are normally not subjected to vibratory or other external forces which might cause the containers to dislodge from a stack, each successive layer may also be arranged in the four-container pattern of FIG. 7 with a tier sheet placed between each layer. As is the case with a pallet load of containers, each successive layer is placed on top surface 22 of the tier sheet which has been secured to the open top area of the layer beneath.

Figure 9:
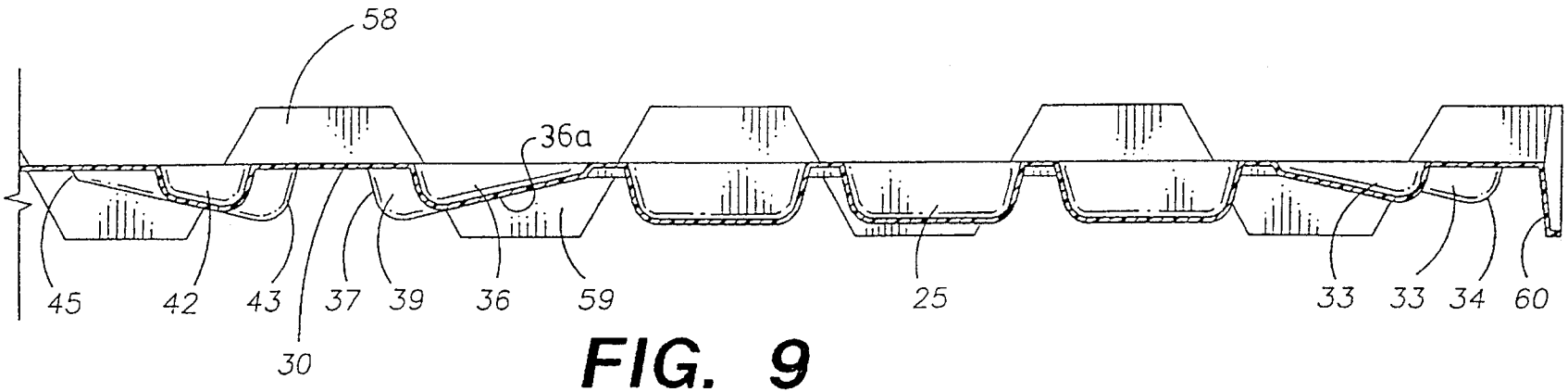
FIG. 9 is a cross-sectional view of a tier sheet according to the present invention taken along line B—B of FIG. 3.

As shown by cross-sectional views 8 and 9, the peripheral edges of each protuberance are at least substantially perpendicular to bottom surface 30 of tier sheet 21. It is preferred, however, that these edges be slightly angled, as shown in FIGS. 8 and 9, so that the widest portion of each protuberance is immediately adjacent bottom surface 30. This slight angling ensures that each protuberance will easily enter within the sidewalls of the open-topped containers. For example, the half-ovoidal protuberance 25 which lies closest to the right end of the tier sheet shown in FIG. 8 has a slightly angled outer contacting edge 26. As protuberance 25 is inserted into a container, edge 26 may not immediately contact the inside of the container sidewall due to its angled nature. As the tier sheet is lowered onto the layer of containers, therefore moving half-ovoidal protuberance further within the confines of a container, the container sidewall will eventually become wedged between contacting edge 26 and a downward extending tab 59.

As also shown by FIGS. 8 and 9, inner surface 61 of upwardly extending tab 58, as well as inner surface 60 of downwardly extending tab 59, are also preferably angled outward slightly in relation to top surface 22 and bottom surface 30 of the tier sheet, rather than being precisely perpendicular. This slightly angled nature (i.e., "substantially" perpendicular) serves the same purpose as that on the protuberances. Of course, this slight angle on both the downwardly and upwardly extending tabs, as well as on the peripheral edges of the protuberances, cannot be too great, else the tier sheet will not perform as intended.

As mentioned previously, when ventilation of the products being shipped is important, the bottom surface of the containers employed with the tier sheet will preferably have a central opening defined by the bottom flaps of the container. Obviously if the containers are placed upon top surface 22 of tier sheet 21, the ventilating effect of this central opening will be eliminated. Thus, as shown in FIG. 4, a plurality of ventilation apertures 65 are preferably provided in tier sheet 21. These apertures can of course be of any shape, size and arrangement, as long as the integrity of the tier sheet is not sacrificed. When apertures 65 are arranged in the pattern shown by FIG. 4, at least a portion of these apertures will be aligned directly beneath the central ventilation opening in the bottom of a container, and above the open top of a container positioned beneath the tier sheet, no matter which of the three layering configurations is employed.

An additional feature of tier sheet 21 is that, as will be noted from an examination of FIG. 3 in conjunction with the layering patterns of FIGS. 5, 6 and 7, all of the protuberances which nest within the comer portions of a container do not have contacting edges which meet at a 90° angle within the container corners. To the contrary, the comer portion of each protuberance (i.e., that portion of each protuberance which will nest within a container adjacent to one of the container comers) is obliquely angled. Thus, comer portion 39 of protuberance 36, as shown in FIGS. 3 and 4 is obliquely angled, rather than of a 90° variety. This helps facilitate the insertion of these protuberances within the sidewalls of the containers, while still supporting the container sidewalls.

The tier sheet of the present invention may be manufactured of any materials using a number of different methods. It is preferred, however, that the tier sheet be singularly molded and that, for considerations of weight and strength, the tier sheet of the present invention be manufactured of plastic, preferably of the injection molded variety. This results not only in a strong and lightweight tier sheet, but also one that is relatively inexpensive to manufacture and is reusable.

As one skilled in the manufacturing of plastic articles will understand, when an item is injection molded a linear grain structure will be present in the article. While this grain structure will resist rotation and flexing in a direction perpendicular to the grain, such will not be the case in a direction parallel to that of the grain. Thus, it is also preferred that in the tier sheet of the present invention a plurality of longitudinal ribs 24 be provided. These longitudinal ribs extend from bottom surface 30 of tier sheet 21 so as to maintain the substantially planar configuration of top surface 22 of the tier sheet. By molding longitudinal ribs 24 into the tier sheet in a direction perpendicular to that of the grain structure, the tier sheet is substantially stiffened and strengthened. This in turn results in a more stable load of containers, when, for example, the tier sheet is used in a load such as that shown by FIG. 10.

When the molding process for the tier sheet of the present invention is completed, the tier sheet must obviously be removed from the mold. It has been found that a slight modification to the protuberances on the tier sheet is preferable in order to facilitate removal of the tier sheet from the mold. It has already been mentioned that the peripheral edges of each protuberances are preferably slightly angled as opposed to being exactly perpendicular to the bottom surface of the tier sheet, and this angling facilitates removal of the tier sheet from the mold. Likewise, by providing a slope to the bottom surface of the protuberance itself (other than on the half-ovoidal protuberances), removal from the mold can be further facilitated. This sloping of these protuberances can be seen in FIGS. 4 and 11 and is more clearly shown in FIGS. 8 and 9. For example, as shown in FIG. 9, bottom surface **36*a* of protuberance 36 is of a sloping configuration in relation to the plane of bottom surface 30** of the tier sheet. Since the contacting edges of these protuberances, however, must be of sufficient thickness to perform their intended function, it is preferred that the thickest portion of each protuberance be adjacent to one or more of the contacting edges of the protuberance.

Figure 12:
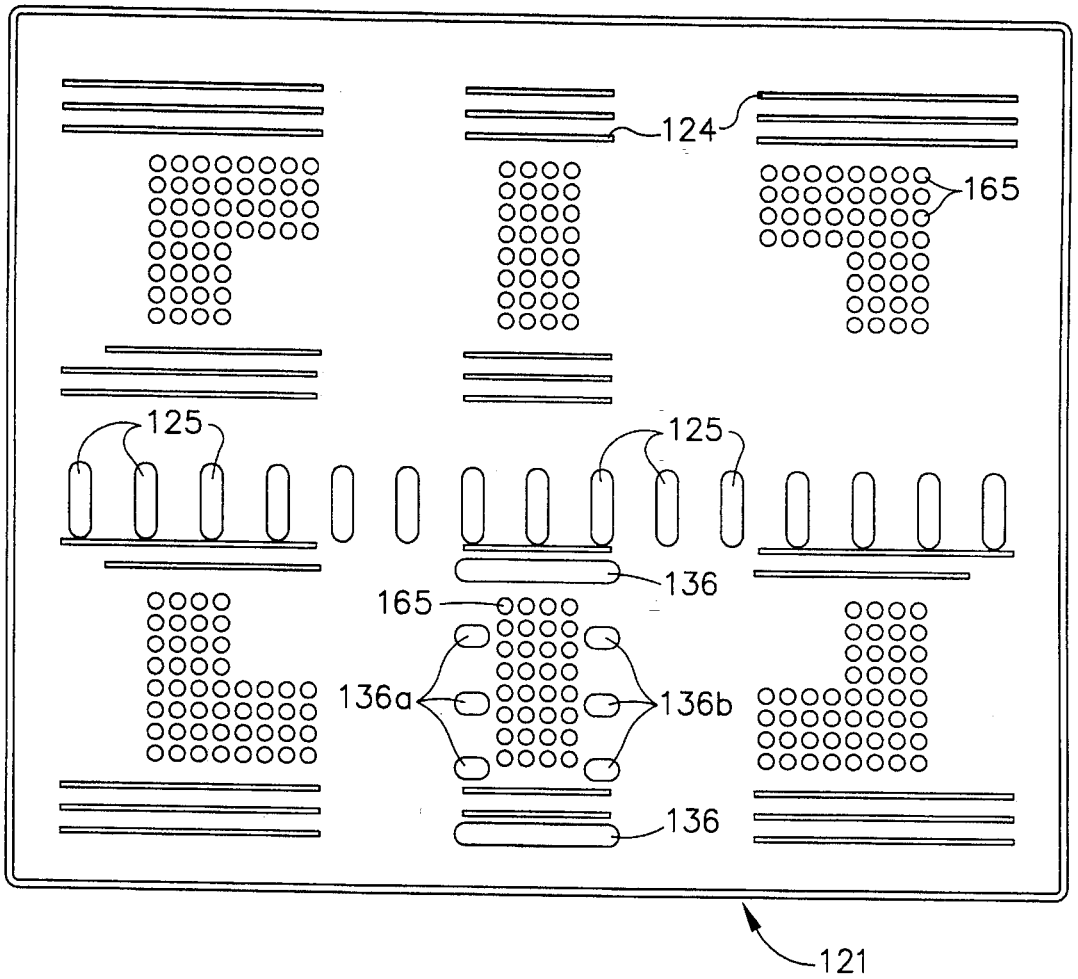
FIG. 12 is a top plan view of another embodiment of the tier sheet of the present invention.
Figure 13:
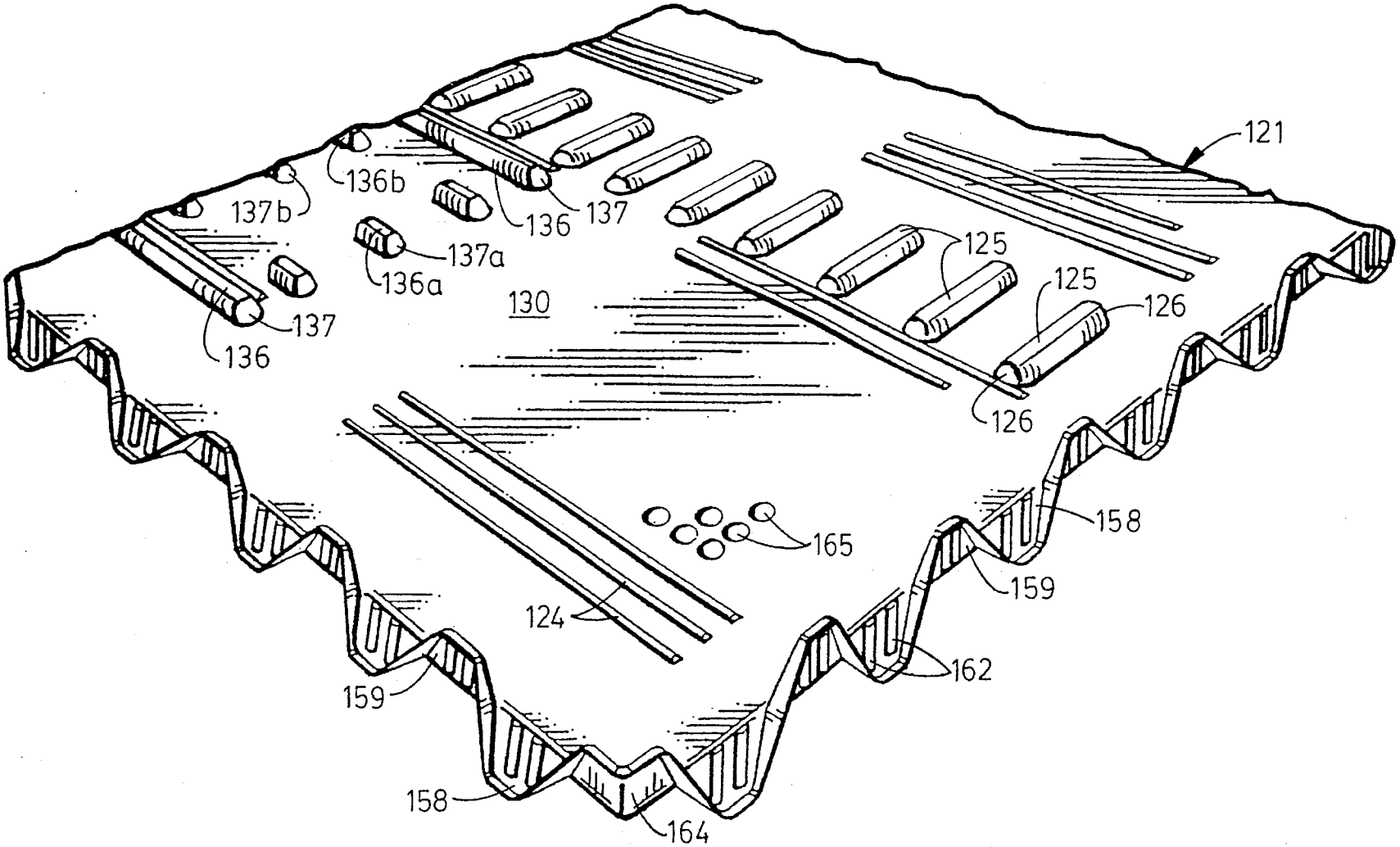
FIG. 13 is partial perspective view of the bottom portion of the tier sheet shown in FIG. 12.
Figure 14:
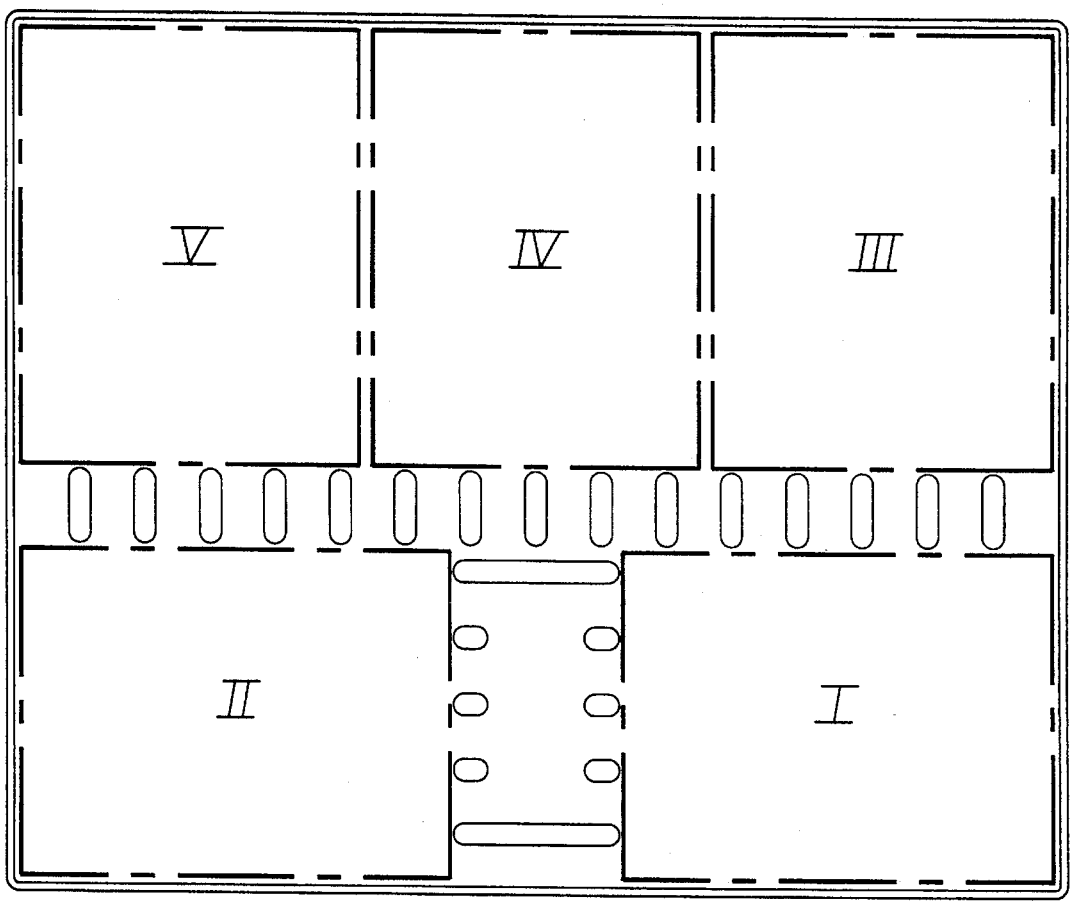
FIG. 14 is bottom plan view of the tier sheet of FIG. 12, and also depicts the outline of a five-container layer onto which the tier sheet has been placed.

FIGS. 12 through 14 depict an alternative embodiment for the tier sheet of the present invention. In contrast to the previously described embodiment, however, the tier sheet of FIGS. 12 through 14 can be employed with containers of either the lidded or lidless variety. As shown by FIG. 12, tier sheet 121 is similar in construction to the tier sheet previously described. Tier sheet 121 has top and bottom surfaces similar to those described previously, and upper and lower retainers are disposed about at least a portion of the perimeter of the top and bottom surfaces, respectively. Once again the upper and lower retainers preferably each comprise a series of spaced tabs extending substantially perpendicularly away from the top and bottom surfaces. As shown in FIG. 13, upwardly extending tabs 158 and downwardly extending tabs 159 are once again offset from one another. In the embodiment of FIG. 13, in contrast to the design of FIG. 11, downwardly extending tabs 159 are preferably disposed around the entire corner of tier sheet 121, thereby providing downwardly extending corner support 164. Comer support 164 acts to further limit the movement of a layer containers positioned beneath tier sheet 121, and particularly prevents rotational movement of the containers. As also described previously, upwardly extending tabs 158 and downwardly extending tabs 159 each have one or more stiffening ribs 162 extending perpendicular away from the top and/or bottom surfaces of the tier sheet. Longitudinal stiffening ribs 124 also extend from bottom surface 130 of tier sheet 121.

Tier sheet 121 also preferably has a plurality of bulbous protuberances depending downwardly away from bottom surface 130. The protuberances on tier sheet 121 are all preferably of a substantially elliptical cross-section, with each protuberance having end walls which are substantially perpendicular. For example first protuberances 125 are substantially elliptical in cross-section, and each have substantially perpendicular end walls 126. By substantially perpendicular it is meant that end walls 126 are preferably slightly sloped in relation to bottom surface 130. A plurality of first protuberances 125 are provided, and are aligned parallel to one another in a spaced apart relationship extending substantially across the entire length of tier sheet 121.

Second protuberances 136 are also preferably provided, and extend downwardly away from bottom surface 130. Protuberances 136 are of a substantially elliptical cross-section, and have substantially perpendicular end walls 137. A plurality of protuberances 136 are provided, and are aligned parallel to one another in a spaced apart relationship extending perpendicularly to the plurality of first protuberances. As further shown by FIG. 12, a portion of the plurality of protuberances 136 may be discontinuous (i.e., comprise two separate protuberances). Thus, protuberances 136 may actually be split into two equivalent protuberances **136*a* and 136*b*, each being substantially elliptical in cross-section and having end walls 137*a* and 137*b* respectively. As will be more fully understood below, this discontinuity of a portion of protuberances 136 permits ventilation apertures 165 to be provided on tier sheet 121 in the area between protuberances 136*a* and 136*b*. Additional ventilation apertures 165 may be provided on other portions of tier sheet 121**, and will be described below.

As stated previously, tier sheet 12 1 may be used with lidded or lidless containers (e.g., the containers of either FIG. 1 or FIG. 2), since the protuberances on tier sheet 121 are designed to snugly engage the exterior sidewalls of the containers. Thus, one first arranges a first tier of containers in a prearranged fashion. Preferably this first tier is of the 5-container configuration shown by FIG. 14. Tier sheet 121 is then placed atop the first tier of containers with the protuberances located between the containers in the manner shown by FIG. 14. The end walls of each protuberance will snugly engage the exterior sidewall of a container, thereby securing tier sheet 121 to the first tier and also limiting the movement of the containers relative to one another. The slightly sloping nature of the end walls of the protuberances also assist one in aligning tier sheet 121 and ensures that each protuberance will be properly positioned between the container sidewalls. Since no protuberances enter the interior of a container, lidded containers may thus be employed. Nevertheless, tier sheet 121 still acts to unitize and stabilize a load of containers. If one desires, a second tier may be placed on the top surface of tier sheet 121 since a substantially planar area is provided on the top surface of tier sheet 121.

One additional advantage of tier sheet 121 is that it may be used in an upside-down configuration. Tier sheet 121 may be placed upside-down atop a first tier of containers since the top surface of the tier sheet is has a substantially planar area. A five-container layer may then be placed atop the upside-down tier sheet in the arrangement shown by FIG. 14. In this fashion, the protuberances will still snugly engage the exterior sidewalls of the containers at the bottom of each container. In this fashion, tier sheet 12 1 will once again act to stabilize and unitize the load of containers.

As will be apparent, when lidded containers are employed, tier sheet 121 can only be placed above and/or below a 5-container layer of the configuration shown by FIG. 14. In the preferred stacking arrangements, however, it is preferable to utilize the layering patterns described in conjunction with FIG. 10 wherein the majority of the layers are of a 6-container variety. When lidded containers are employed, one can either stack the 6-container layers atop one another in the manner of the prior art, or a modified tier sheet similar to tier sheet 121 yet lacking any bulbous protuberances (i.e., substantially planar on both the top and bottom surfaces). Such a tier sheet would still offer advantages over the prior art, as the upper and lower peripheral retainers will act to limit movement of the containers in a layer relative to one another, and will thereby act to unitize and stabilize the entire load.

As also shown by FIG. 12 and 13, a plurality of ventilation apertures 165 are provided, preferably in the predetermined arrangement of FIG. 12. When arranged in this fashion, and when a container of the design shown by FIG. 1 is employed, a plurality of apertures 165 will be aligned directly beneath the central ventilation opening 8 in the base of each container 1 placed atop tier sheet 121. Furthermore, this plurality of apertures 165 will also be aligned directly above the central opening in the lid portion 2 of each container 1 positioned beneath tier sheet 121. This alignment will be present when the layers above and below tier sheet 121 are of the 6- or 5-container layering patterns described previously. It should be noted that this same pattern of ventilation apertures could be employed for the first tier sheet described while still providing fluid communication between layers of containers positioned above and below the tier sheet.

Finally, once again there are preferably depressions in the top surface of tier sheet 121 corresponding to the bulbous protuberances depending from bottom surface 130. This ensures that tier sheet 121 may be nestingly stacked atop a tier sheet of like construction during storage or shipment of a plurality of such tier sheets.

While the present invention has been described in conjunction with specific embodiments thereof, numerous equivalent alternatives, modifications, and variations will be apparent to one skilled in the art in light of the foregoing description. Accordingly, the scope of the present invention should be defined by the claims appended hereto.

What we claim is:

1. In combination, a plurality of containers having sidewalls, said containers stacked in at least two layers comprising an upper layer and a lower layer, and a tier sheet positioned between said upper and lower layers, said tier sheet comprising:

(a) a top surface having an outer perimeter and a substantially planar area for supporting said upper layer;

(b) a bottom surface having an outer perimeter;

(c) a peripheral upper retainer disposed about and extending upwardly away from at least a portion of the perimeter of said top surface; and (d) a plurality of protuberances depending downwardly away from said bottom surface;

such that said upper retainer retains said upper layer on said top surface, and wherein said protuberances are located so as to snugly engage the sidewalls of at least a portion of the containers of said lower layer, thereby stabilizing said lower layer of containers in a predetermined arrangement wherein said tier sheet further comprises a peripheral lower retainer disposed about and extending downwardly away from at least a portion of the perimeter of said bottom surface, such that said lower retainer further stabilizes said lower layer by restricting the movement of the containers of said lower layer relative to one another; wherein said containers are of an open-topped, lidless variety, and wherein at least a portion of said protuberances snugly engage the interior sidewalls of the lower layer of containers; wherein each of said containers is rectangular in shape, and further wherein each of the four corners of the open top of each container of said lower layer has at least one protuberance nesting therein.

2. The combination of claim 1, further wherein a portion of said protuberances are half-ovoidal in shape, said half-ovoidal protuberances snugly engaging the interior sidewalls of said lower layer between said four corners.

3. The combination of claim 1, wherein at least one of said layers has at least one void space, thereby providing additional ventilation to the containers.

4. The combination of claim 1, wherein each of said containers of said upper layer has a central ventilation opening in its base, and further wherein said tier sheet has a plurality of ventilation apertures, at least a portion of said apertures positioned directly beneath said ventilation opening and directly above the open top of a container of said lower layer.

* * * * *